United States Patent [19]

Hanula

[11] Patent Number: 4,597,499

[45] Date of Patent: Jul. 1, 1986

[54] BIASED PIN RETAINER BLOCK FOR A ROTARY COUPLING SYSTEM

[76] Inventor: Richard M. Hanula, 5012 N. Barton Rd., Lyndhurst, Ohio 44124

[21] Appl. No.: 622,533

[22] Filed: Jun. 20, 1984

[51] Int. Cl.[4] ..... B61G 9/00

[52] U.S. Cl. ..... 213/50.5; 213/62 A; 213/69; 403/154; 403/379

[58] Field of Search ..... 213/62 A, 62 R, 67 R, 213/64, 60, 69, 71, 72, 50.5; 411/549-553, 349; 403/154, 324, 379

[56] References Cited

U.S. PATENT DOCUMENTS

| | | | |
|---|---|---|---|
| 2,123,068 | 7/1938 | Summers | 411/552 |
| 2,973,105 | 2/1961 | Metzger | 213/71 |
| 3,157,291 | 11/1964 | Kulieke et al. | 213/62 A |
| 3,924,544 | 12/1975 | Grau et al. | 411/349 |

FOREIGN PATENT DOCUMENTS

| | | | |
|---|---|---|---|
| 535264 | 7/1955 | France | 213/62 A |
| 1203323 | 1/1960 | France | 213/62 A |

*Primary Examiner*—Robert B. Reeves
*Assistant Examiner*—Dennis C. Rodgers

[57] ABSTRACT

A rotary coupling system for railroad cars and the like includes a rotary connector which is mounted in a yoke and to which a car coupler is attached for unitary rotation. The yoke has an aperture or opening through which a pivot pin is inserted into aligned pin receiving holes in the rotary connector and a shank of the car coupler. An improved pin retainer block is provided to selectively close the opening and retain the pin in the receiving holes. Plural flanges extending radially outward of the retainer block provide support therefor in the yoke pivot pin opening between inner and outer radially inward extending support surfaces. The support surfaces are axially spaced apart from each other a predetermined distance for accommodating predetermined limited axial movement of the retainer block in the pivot pin opening. A spring-biasing means acting on the retainer block continuously urges it toward an innermost position with the flanges thereof in contact with the inner support surface of the yoke pivot pin opening. The dimensioning and spacing of the support surfaces, retainer block, pivot pin, and other system components are such that under the influence of the retainer block, the pivot pin is urged toward contact with the wall of the yoke at the area thereof disposed opposite the pivot pin opening. Such action enhances pivot pin location in the rotary connector and compensates for wear in order to better maintain integrity for the coupling system components.

18 Claims, 7 Drawing Figures

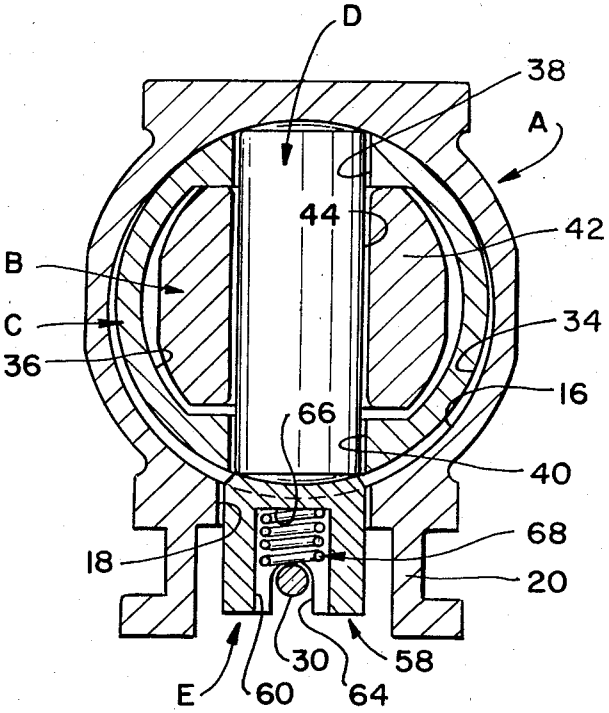
FIG. 2
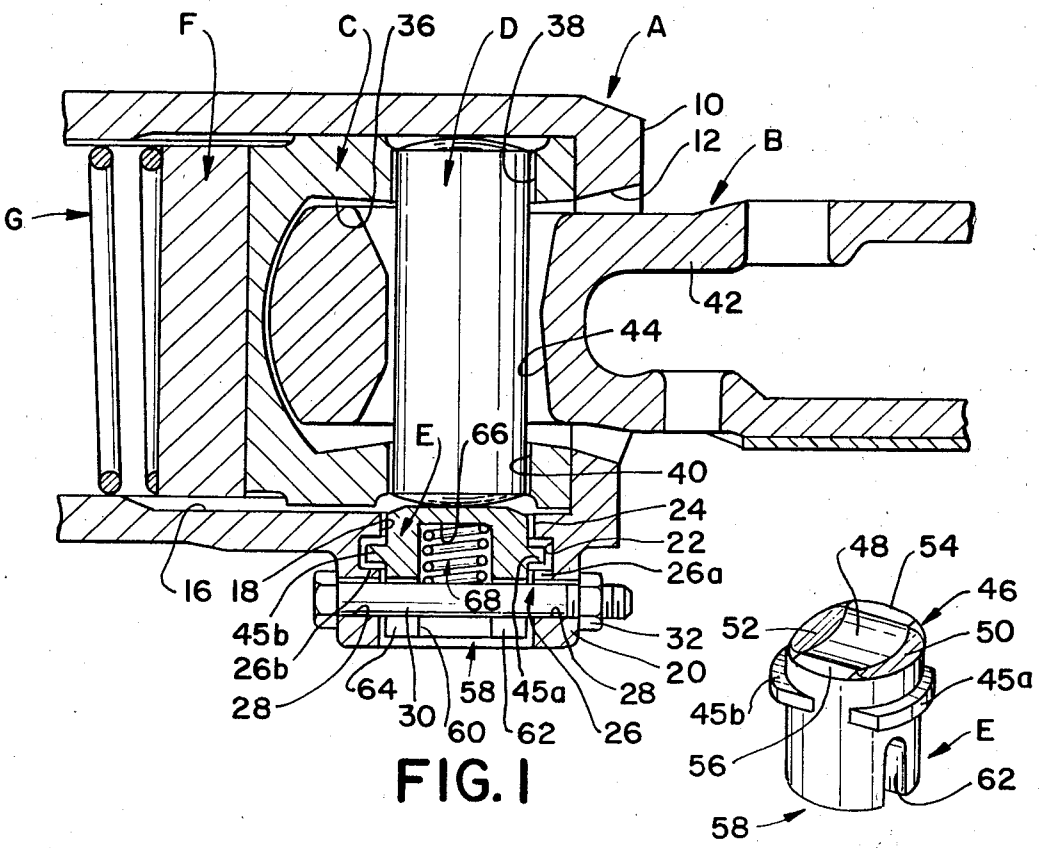
FIG. 1
FIG. 3

BIASED PIN RETAINER BLOCK FOR A ROTARY COUPLING SYSTEM

BACKGROUND OF THE INVENTION

This invention generally pertains to coupler systems for railroad cars and the like. More specifically, the present invention relates to a biased pin retainer block for a rotary coupler system. While the invention is particularly applicable to use the type F rotary couplers described herein, it will be appreciated by those skilled in the art that the invention has broader applications and may also be adapted for use in other coupler environments.

After the introduction of the rotary coupling system, a train comprised of loaded railroad cars of the open top or hopper type (which may contain coal, ore, etc.) could be emptied without having to uncouple and separate the cars. This was accomplished by rotating each car up to 180° about its longitudinal centerline while it remained connected on both ends to the next adjacent cars to thereby more efficiently accommodate gravity emptying. Such coupling systems typically include a yoke, a coupler unit, a rotary connector, a pivot pin, and a pin retainer block.

In rotary coupling systems, the coupler has a shank portion with an aperture extending transversely therethrough. The rotary connector is rotatably received in the yoke and has an end opening for receiving the coupler shank. The connector also has a pair of spaced apart coaxial apertures which are alignable with the shank aperture. A pivot pin is insertable into the aligned connector and shank apertures for selectively interconnecting these two components. The yoke has an opening in the bottom wall thereof which is alignable with the connector and coupler shank apertures for permitting selective installation and removal of the pivot pin into and out of association with the connector and coupler shank. A pin retainer block is selectively mountable in a covering relationship with this yoke opening to support the pivot pin and thereby retain the rotary connector and coupler shank in an interconnected relationship.

One problem with prior rotary coupling systems has been in obtaining suitable support for the pivot pin to eliminate uneven or destructive wear on the coupler system components. For example, the pin is not centrally located at both ends thereof in the connector apertures. The pivot pin is received through only a portion of the connector top or upper aperture. When the pivot pin slips downwardly in this upper aperture, rapid wear due to insufficient bearing forms a ledge into the forward wall thereof. This causes premature wear of the connector and necessitates disassembly of the coupler assembly for connector replacement. Also, as the pin tilts forward, it causes eccentric wear to the coupler shank at the rear of its aperture. Still further, difficulty in rotation of the coupler in dump situations has been experienced, particularly under pull conditions, in that the pin is prevented from moving upwardly to free itself due to the presence of the ledge worn into the connector wall by the pivot pin itself.

A partial solution which has been proposed for this problem employs a rubber pad positioned within an opening in a cylindrical pin retainer block. The pin retainer block is held in position by a fastener plate which is secured through aligned openings in the retainer block and in the yoke head. When the fastener is removed, the retainer block can be lowered away from the yoke head. The rubber pad is interposed between the fastener plate and the retainer block. The difficulty with this prior arrangement has been that rubber is not very compressible without undue force, and there is no means provided for initial compression during assembly. Thus a rubber pad does not have the necessary force/travel characteristics even for the intended purpose of taking up slack between the pin retainer block, the fastener plate, and the yoke. Further, the rubber pad does not properly compensate for variations in pivot pin lengths or wear incurred during service.

Accordingly, it has been considered desirable to develop a new and improved pivot pin support structure for a rotary coupler which would overcome the foregoing difficulties and others, and meet the above stated needs while providing better and more advantageous overall results.

BRIEF SUMMARY OF THE INVENTION

In accordance with the present invention, a new and improved biased pivot pin retainer block is provided for a railway car coupler system.

More particularly in accordance with the invention, a rotary coupling system for rail cars and the like includes a coupler having a shank portion including an aperture extending transversely therethrough and a connector means having an end opening for receiving the shank. The connector means includes a pair of spaced apart coaxial apertures aligned with the shank aperture, and is rotatable about an axis of rotation normal to the axis of the aligned apertures. Fastening means is provided which is insertable into the aligned connector means apertures and the shank aperture for selectively interconnecting these two components. A yoke rotatably retains the connector means, and includes an opening which is alignable with the connector means and the coupler shank apertures. Retaining means selectively insertable into the yoke opening is provided for closing the opening in order to retain the fastening means in connecting relation with the connector means and shank apertures. A locking means is provided for selectively locking the retaining means in a closing position in the yoke opening. Compressible biasing means operatively communicates with the retaining means for placing a continuous biasing force thereagainst for urging the retaining means axially inward of the yoke opening toward the yoke interior. First limit means defines an inward limit of movement of the retaining means, and second limit means defines an outward limit of movement.

In accordance with another aspect of the invention, the first and second limit means are spaced apart from each other axially of the yoke opening by a predetermined distance for accommodating maximum tolerance variations of the system components while allowing the retaining means to urge the fastening means toward engagement with the wall of the yoke opposite the yoke opening.

According to a further aspect of the invention, the yoke opening includes first inner and second outer support surfaces extending circumferentially thereof in an axially spaced relation to each other. The first and second support surfaces define the first and second limit means, respectively, and the retaining means includes radially outward support areas receivable between the first and second support surfaces. The distance between the support surfaces is a predetermined amount greater than the thickness of the support areas for allowing the retaining means to undergo a predetermined amount of axial movement.

According to one embodiment of the invention, the retaining means is generally cylindrical. One face of the retaining means has a contoured, generally saddle-shaped surface extending parallel to the axis of rotation of the connector means when the retaining means is disposed in the closing position in the yoke. The other face of the retaining means is provided with an axial opening and a pair of apertures aligned transversely of the opening through the retaining means side wall. The locking means extends through these aligned apertures and compatible aligned apertures in the yoke to effect locking of the retaining means in the yoke opening. The biasing means is operatively interposed between the locking means and retaining means.

In accordance with another embodiment of the invention, the retaining means includes a generally disc-shaped retainer block and a retainer block insert which are cooperably associated with the biasing means interposed therebetween. In this arrangement, the second support surface is defined by a plurality of support surface segments spaced apart from each other around the yoke opening. The retainer block has a plurality of radially outward extending flanges and the retainer block insert has a plurality of radially outward extending fingers. The flanges and fingers are cooperable with each other to secure the retainer block and retainer block insert against relative rotation.

In accordance with still another aspect of the invention, the fingers of the retainer block cooperate with the support surface segments for maintaining the retaining means in the yoke opening. The biasing means urges the retainer block flanges toward engagement with the first support surface and the retainer block insert fingers into a cooperable relationship with the support segments.

According to yet a further aspect of the invention, a new spring-biased, floating type of retaining block in combination with a yoke for a coupler system is advantageously provided.

The principal advantage of the present invention is the provision of a new rotary coupling system which includes a biased pin support or retaining block to obtain full load bearing capabilities for an associated connecting or pivot pin.

Another advantage of the invention resides in a spring-biased pin retainer block which maintains the pivot pin in a coupler system so that there is no restriction in connector rotation within the bore of an associated yoke.

Yet another advantage of the invention is the provision of a floating retainer block which has sufficient travel to account for tolerances of the yoke bore, the connector, the diameter and length of the pivot pin, and wear incurred in service.

Still another advantage of the present invention is the provision of a floating retainer block designed to exert a pressure which allows ease of installation and provides minimal force of the pivot pin against the area of the yoke bore opposite the yoke opening to minimize wear.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof, and wherein:

FIG. 1 is a side elevational view in cross-section of a rotary coupling assembly which incorporates a preferred embodiment of the subject new spring-biased pin retainer block;

FIG. 2 is a transverse cross-sectional view of the rotary coupling assembly of FIG. 1 taken generally at the area of the pivot pin;

FIG. 3 is a perspective view of the pin retainer block used in the embodiment of FIGS. 1 and 2;

DETAILED DESCRIPTION OF THE PREFERRED AND ALTERNATE EMBODIMENTS

Figure 4:
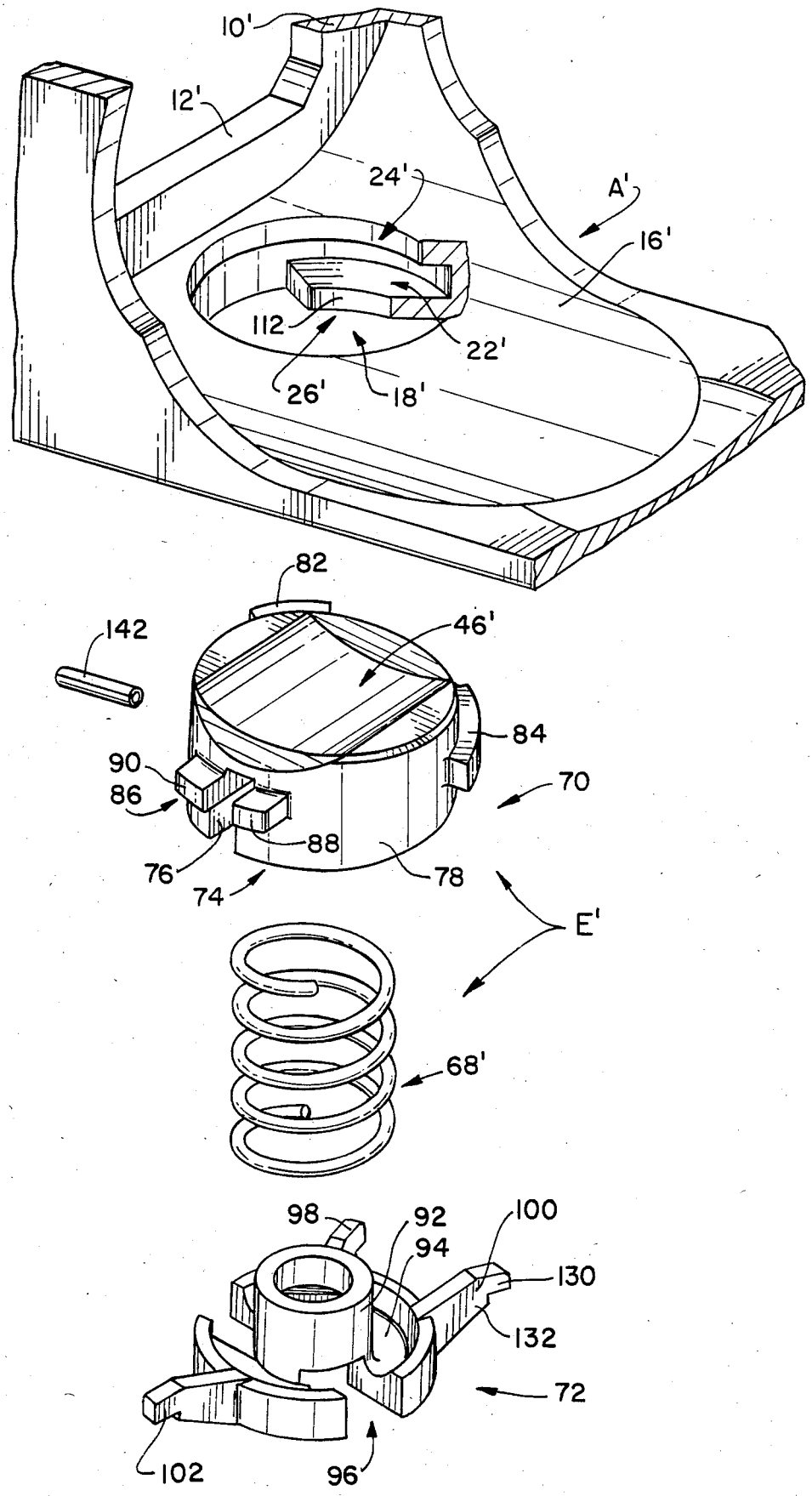
FIG. 4 is an exploded perspective view of an alternate embodiment of a spring-biased pin retainer block constructed according to the invention.

Referring now to the drawings wherein the showings are for purposes of illustrating preferred and alternate embodiments of the invention only and not for purposes of limiting same, FIG. 1 shows a rotary coupling system including a yoke A and a coupler unit B. A rotary connector C rotatably housed in the yoke is used to interconnect the yoke and coupler unit B through a pivot pin D. This pin is retained in position by means of a pin retainer block E mountingly received in an aperture or pivot pin entry opening of the yoke. A front follower F cooperates with the butt end of connector C or coupler unit B under the influence of a resilient cushion or draft gear G as is conventionally known. The general conformation and operation of one type of rotary coupler system is described in greater detail in the commonly assigned U.S. application Ser. No. 519,279, filed Aug. 2, 1983, non-essential teachings of which are incorporated hereinto by reference.

Pivot pin D preferably is cylindrical and, as previously noted, directly fastens or couples rotary connector C to the coupler unit B. Since the rotary connector is rotatably mounted in yoke A, coupler unit B may be selectively rotated about the longitudinal centerline of the yoke approximately 180° to facilitate unloading of an associated open top railway car or other vehicle by inverting the car relative to the adjacent cars as is known.

A front end area 10 of yoke A has a centrally disposed, generally cylindrical opening 12 which communicates with a larger diameter cylindrical opening extending longitudinally inward of the yoke. This enlarged opening is defined by a curved inner peripheral wall 16 as best shown in FIG. 2.

A pivot pin entry opening or aperture 18 penetrates the yoke inner peripheral wall 16 at a radial collar 20 to communicate with the yoke interior. Opening 18 is generally cylindrical and includes an internal groove 22 extending circumferentially thereof in facing relation therewith. This groove defines and separates inner and outer flange areas 24, 26 which surround opening 18 adjacent the open inner and outer ends thereof. The opposed, facing surfaces of these flanges, ie., the opposed side walls of groove 22, are laterally spaced apart by some predetermined distance for reasons to be described. Inner flange area 24 is continuous in nature, and outer flange area 26 is comprised of a pair of separate flanges 26*a* and 26*b* spaced opposite each other around opening 18. While two separate flanges are employed in the preferred embodiment, a different number could also be satisfactorily used without departing from the overall intent and scope of the invention. Yoke A advantageously includes a pair of spaced apart, aligned holes 28 adapted to receive a retainer block fastener 30. As shown, this fastener comprises an elongated threaded fastener which receives a nut 32 on the outer end thereof.

As best shown in FIG. 2, rotary connector C has a curved outer cylindrical periphery 34 which substantially corresponds to curved inner periphery 16 of yoke A. The rotary connector also includes a centrally disposed axial opening 36 and a pair of spaced apart pin receiving apertures 38, 40 which are aligned transversely thereacross. An elongated shank 42 of the coupler B is dimensioned for receipt in opening 36 of the rotary connector C. The shank also includes an aperture 44 extending transversely therethrough. Pivot pin D is inserted through opening 18 in the yoke into the aligned apertures 38, 40 of rotary connector C and aperture 44 of the coupler B.

Pin retainer block E can be inserted into the pin entry opening 18 once the pivot pin D is in place. A pair of diametrically opposed support ears or flanges 45*a*, 45*b* extend radially outward of the retainer block for selective retaining cooperation with groove 22 in aperture 18. Ears 45*a*, 45*b* have an arcuate dimension which allows them to be received between the arcuate spaces defined between flanges 26*a*, 26*b*. Thus, the retainer block construction is such that rotation thereof by approximately 90° installs the block and prevents disassociation thereof from the yoke. The thickness of ears 45*a*, 45*b* is less than the width of groove 22 in order that the retainer block may be axially shifted in aperture 18 between defined limits in a manner and for reasons to be described.

With principal reference to FIG. 3, retainer block E is defined by a generally cylindrical body having generally opposed face areas. An inner face 46 has a concave, saddle-shaped surface 48 defined between a pair of spaced apart beveled, curved surfaces 50, 52 at opposed end areas and a pair of ridges 54, 56 at opposed side areas. An outer face 58 is provided with an axially inward extending recessed area 60 (FIGS. 1 and 2) as well as a pair of diametrically opposed slots 62, 64. The slots are located so that they are alignable with holes 28 in yoke collar 20 when the retainer block is properly positioned in yoke opening 18. Fastener 30 extends through slots 62, 64 to prevent undesired rotation of the retainer block while allowing limited axial movement thereof.

Positioned in the retainer block recessed area 60, between the fastener 30 and a retainer block inner face 66, is a biasing member 68 which, in the preferred embodiment, takes the form of a helical compression spring. Biasing means 68 is designed to have sufficient force/travel characteristics under both adverse tolerance and component wear conditions to assure urging of one end of pivot pin D toward contact with an upper portion of yoke inner periphery 16, at least when coupler B is in its neutral position. In other words, pivot pin D is continuously urged toward contact with the yoke inner periphery 16. This assures that the pivot pin will be moved fully into the connector upper aperture 38 to better transfer loading forces between coupler B and yoke A. At the same time, the biasing means is designed to provide minimal force against the upper area of yoke peripheral wall 16 to minimize wear between the pin and the yoke, and to allow for easy installation and assembly by hand. Although a compression spring is shown, other types of biasing means or mechanical springs, such as Belleville springs or leaf springs, could also be used for the same purpose.

As noted, the width of groove 22 is greater than the thickness of ears 45*a*, 45*b* to facilitate some axial movement of the retainer block in aperture 18. The side wall of flange 24 provides an upper limit to this movement, and the side walls of flanges 26*a*, 26*b* provide a lower limit to this movement. The upper limit is such that in that position, inner face 46 of the retainer block is in its maximum permissible inserted position into the interior of yoke A without causing interference with connector C and preventing operation of the coupler system in its intended manner. The lower limit is such that the at least some axially outward movement of the retainer block is still possible even when pivot pin D and block E have their greatest permissible lengths and yoke A has its minimum permissible diameter, inclusive of tolerance allowances. It is desired that retainer block E float in its mounting between the inner and outer limits under all tolerance conditions of the various components which comprise the coupler system. The floating nature of the retainer, again, insures that pivot pin D will be urged into or toward contact with that portion of the yoke inner wall opposed from aperture 18. Moreover, even with an undersized pivot pin and with the retainer position in its innermost position, the pin will at least be moved to the maximum available penetration into connector aperture 38.

With reference now to the alternate embodiment of FIGS. 4–7, the invention is there shown as being incorporated into a different type of pin retainer block. For ease of illustration and appreciation of this alternative, like components are identified by like numerals with a primed (′) suffix and new components are identified by new numerals.

In FIG. 4, yoke A′ is provided with a pin receiving aperture 18′ in which can be positioned a pin retainer block structure E′ comprised of a generally cup-shaped upper block member of portion 70 and a lower block insert 72. The upper portion is provided with an inner, saddle-shaped face 46′ in the same manner previously described and an open outer end 74. A through slot 76 in upper portion side wall 78 extends axially from end 74 and communicates between the exterior and the hollow interior of the upper portion. A central, axial stem 80 (FIGS. 6 and 7) is located within the hollow interior of the upper portion. Two additional slots similar to slot 76 are also included in side wall 78 at spaced intervals therearound for reasons and purposes to be described. Upper portion 70 is further provided with three equidistantly spaced apart support ears or flanges 82, 84, 86 projecting radially outward therefrom. Support ear 86, in turn, is defined by a pair of ear halves 88, 90 disposed on each side of slot 76.

Figure 5:
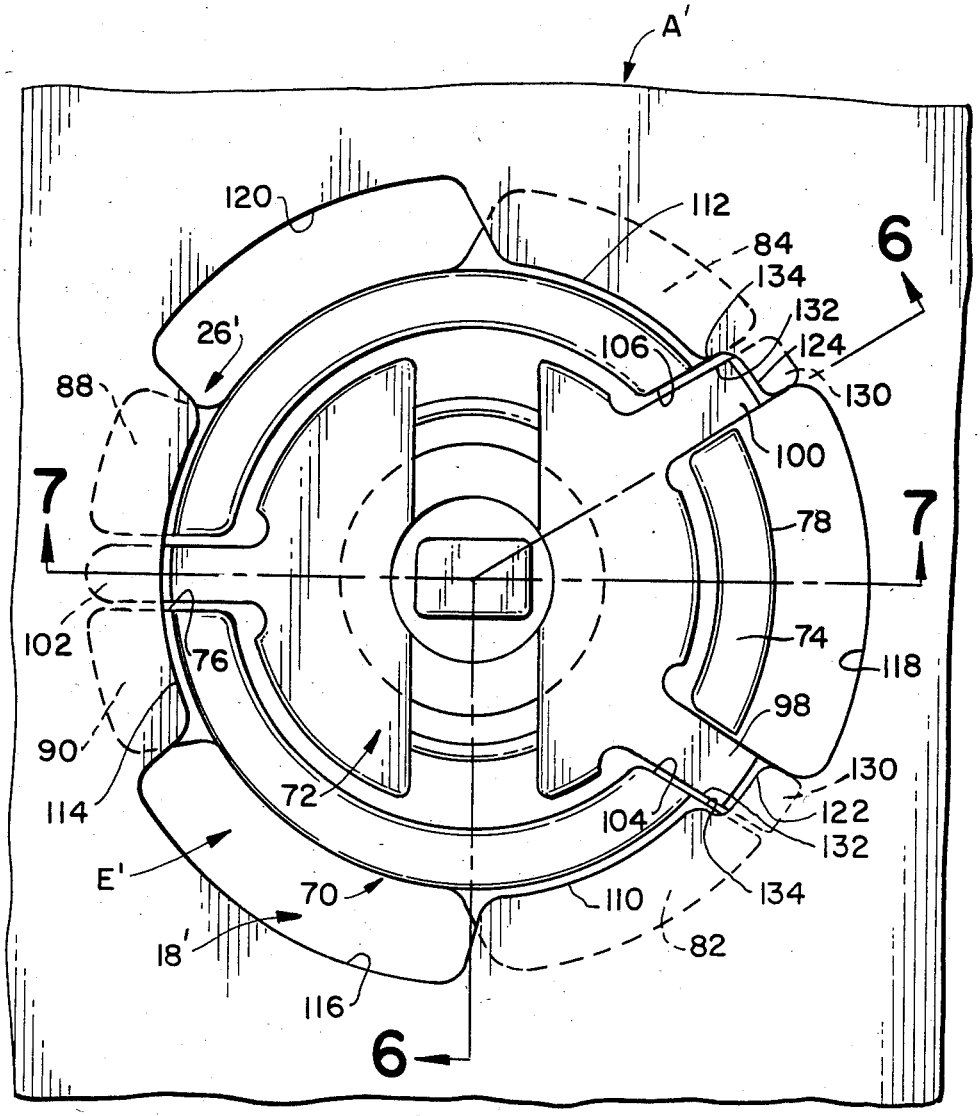
FIG. 5 is a somewhat schematic bottom view of the yoke taken generally in the direction of lines 5—5 of FIG. 7 for showing the alternate pin retainer block construction in an installed position.
Figure 6:
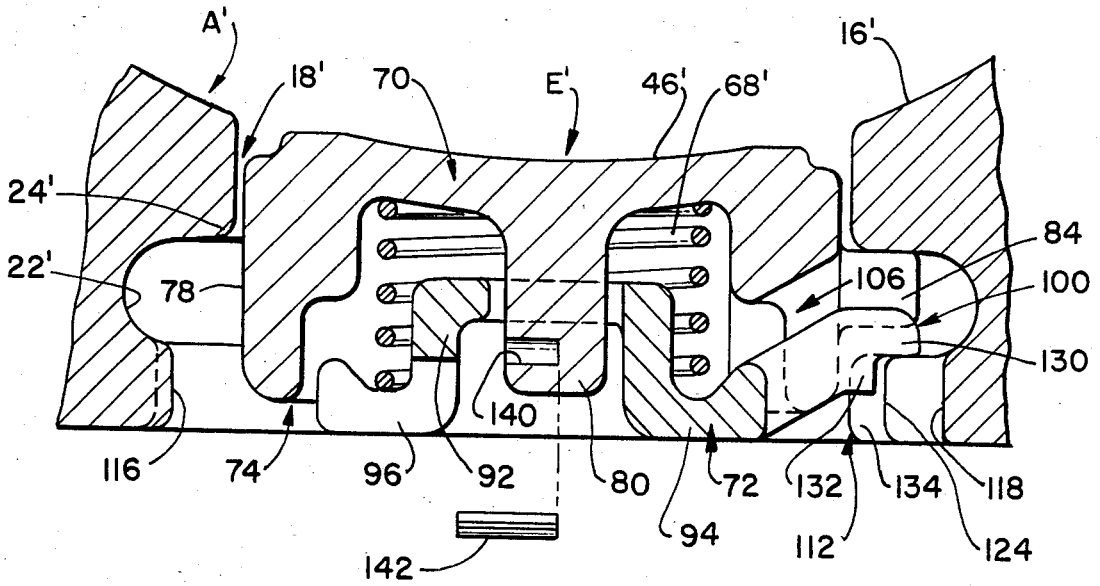
FIG. 6 is an enlarged cross-sectional view taken generally along lines 6—6 of FIG. 5; and, FIG. 7 is an enlarged cross-sectional view taken generally along lines 7—7 of FIG. 5.

The lower block insert 72 includes a hollow, cylindrical center portion 92 which receives upper portion stem 80 in the assembled condition. A wall portion 94 extends radially outward from the bottom of center portion 92 and has a slot or groove 96 extending diametrically thereacross. Three finger portions 98, 100, 102 extend radially outward from wall portion 94 at spaced intervals therearound. These fingers are spaced such that finger 102 is receivable in slot 76 between ear halves 88, 90. As shown in FIG. 5, fingers 98, 100 are receivable in slots 104, 106 in upper portion side wall 78 on the adjacent or facing sides of ears 82, 84, respectively. Finger 100, slot 106, and ear 84 are also shown in FIG. 6, it being appreciated that the relationship between finger 98, slot 104 and ear 82 is identical thereto. When the upper block portion and block insert are placed in a cooperative relationship with the insert fingers in the upper portion slots, relative rotation between these two components is prevented.

Upper block portion support ears 82, 84, 86 and insert member fingers 98, 100, 102 are adapted to be placed in a cooperative relationship with a groove 22' which surrounds pin receiving aperture 18' in the yoke (FIG. 4). This groove is defined by a continuous inner wall or flange 24' and a discontinuous outer wall or flange 26' in much the same manner previously described. In this embodiment, flange 26' is defined by three radial support ledges or flanges 110, 112, and 114 in the manner best shown in FIG. 5. The arcuate dimensioning of and spacing between these support flanges is such that the retainer block support ears may be received therebetween, ie., through clearance areas 116, 118, and 120, when the retainer block is being installed. In this case, the retainer block is rotated approximately 60° in order to place it in the installed position shown in FIG. 5. The adjacent or facing areas of support flanges 110 and 112 are provided with support extensions 122, 124, respectively, at each end of clearance area 118. Each of these support extensions is adapted to cooperate with a respective one of fingers 98 and 100.

Figure 7:
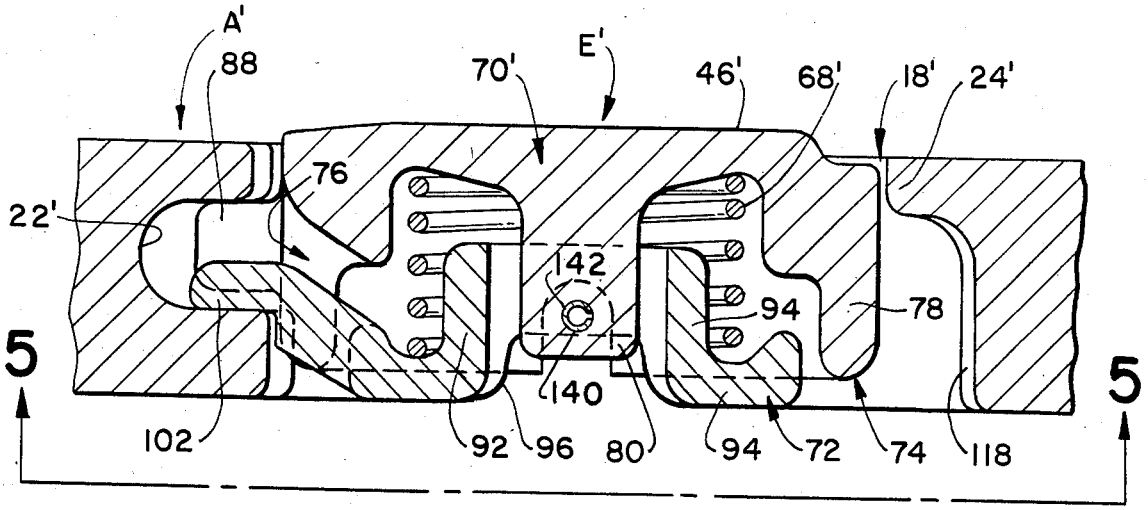

With continued reference to FIGS. 5, 6, and 7, finger 100 has a portion 130 thereof extending onto support extension 124 while another portion 132 abuts an edge surface 134 of flange 112. Finger 98 has an identical conformation for similarly cooperating with flange 110 and extension 122. Finger 102 cooperates with the support flange 114. When the retainer block components are in the foregoing position, rotation of the pin retainer block in aperture 18' is prevented because of the abutment of the finger portions against the sides of support flanges 110 and 112. More particularly, rotation in a clockwise direction in FIG. 5 is prevented by abutment of portion 132 of finger 98 against side edge 134 of support flange 110, and rotation in a counterclockwise direction is prevented by a similar abutment between finger 100 and support flange 112.

A spring member 68' is positioned in the hollow interior of upper block portion 70 in surrounding relation with center portion 92 of block insert 72 to place a biasing force against the upper and lower members to urge them apart from each other. At the same time, stem 80 of the upper portion is received in the hollow interior of center portion 92. When the retainer block is installed, the foregoing spring arrangement urges upper portion support ears 82, 84, 86 toward contact with the inner stop defined by flange 24', ie., the upper wall of groove 22', and moves the lower block insert fingers 98, 100, 102 into contact with the outer flange 26' as defined by support ledges 110, 112, and 114. Although FIGS. 6 and 7 show the upper portion ears as being in contact with flange 24', it is to be appreciated that when retainer block assembly E' is supporting a pivot pin, dimensioning of the components is such that ears 82, 84, 86 will be spaced from contact with flange 24'. That is, upper block portion 70 will be disposed in a floating relationship with entry opening 18' in the same manner and for the same reasons described above with reference to the embodiment of FIGS. 1–3. In order to rotate the pin block E' into and out of engagement with the yoke flanges, an upward force must be exerted against the lower block insert 72 in order to lift fingers 98, 100 away from the above described restraining engagement with edge surfaces 134 of support ledges 110, 112.

For installation purposes, an aperture 140 advantageously is provided in stem portion 80 into which a pin or fastener 142 can be inserted when spring 68' is compressed for assembly. Such insertion is accommodated through slot 96 in retainer block insert 72 as is best shown in FIG. 6. This enables easy shipment and insertion of the retainer block assembly E' into yoke aperture 18'. Once the retainer assembly E' is rotated into place with spring 68' being further compressed, pin or fastener 142 is no longer functional until assembly E' is removed. Spring 68' can then urge members 70, 72 apart from each other as described above and lock the retainer block assembly into place. Although pin or fastener 142 is shown as comprising a roll pin, it will be appreciated that other types of fasteners could also be suitably employed.

Operation of this alternative embodiment is substantially identical to the preferred embodiment as hereinabove described. Here, too, when the retainer block is supporting a pivot pin, it is desired that upper block portion 70 float somewhere intermediate a bottomed out relationship with lower insert 72 and an engaging relationship by ears 82, 84, 86 with the inner wall of groove 22', ie., flange 24'. This relationship is deemed to provide the best overall operational results.

The subject invention provides a retainer block construction and mounting having a biasing means with force/travel characteristics suited for urging the retainer block into the yoke and thus urging the pivot pin against an upper surface of the yoke each time the coupler passes through its neutral position, even when the coupler parts have become worn. At the same time, the biasing means provides minimal force of the pin against the surface of the yoke bore to minimize wear and allow for easy installation by hand.

The invention has been described with reference to preferred and alternate embodiments. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A rotary coupling system for rail cars and the like, comprising:

a coupler having a shank portion including an aperture extending transversely therethrough;

connector means having an end opening for receiving the shank and a pair of spaced apart coaxial apertures alignable with said shank aperture, said connector means being rotatable about an axis of rotation normal to the axis of said aligned apertures;

fastening means insertable into said aligned connector means apertures and said shank aperture for selectively interconnecting said coupler and connector means;

a yoke for rotatably retaining said connector means, said yoke having an opening which is alignable with said connector means apertures and said coupler shank aperture and adapted to receive the fastening means therethrough;

retaining means for retaining said fastening means in a connecting position with said connector means apertures and said shank aperture, said retaining means being selectively insertable into said yoke opening for closing said opening and further including a locking means for selectively locking said retaining means in a closing position in said yoke opening;

compressible biasing means comprising a compression spring operatively communicating with said retaining means for placing a continuous biasing force thereagainst for urging said retaining means axially inward of said yoke opening toward the fastening means; and, first limit means for defining an inward limit of movement of said retaining means in said yoke opening and second limit means for defining an outward limit of movement of said retaining means in said yoke opening wherein said yoke opening includes first inner and second outer support surfaces extending circumferentially thereof in axial spaced relation to each other, said first and second support surfaces defining said first and second limit means, respectively, said retaining means including radially outward extending support areas receivable between said first and second support surfaces, the distance between said surfaces being a predetermined amount greater than the thickness of said support areas for allowing said retaining means to undergo predetermined amount of axial movement.

2. The rotary coupling system of claim 1 wherein said first and second limit means are spaced apart from each other axially of said yoke opening by a predetermined distance for accommodating maximum tolerance variations in the system components while allowing said retaining means to urge said fastening means toward engagement with the wall of said yoke opposite from said yoke opening.

3. The rotary coupling system of claim 2 wherein said retaining means includes a generally disc-shaped retainer block and a retainer block insert which are cooperably associated with said biasing means interposed therebetween.

4. The rotary coupling system of claim 2 wherein said retaining means is generally cylindrical, one face of said retaining means having a contoured generally saddle-shaped surface extending parallel to the axis of rotation of said connector means when said retaining means is disposed in the closing position in said yoke.

5. The rotary coupling as defined in claim 4 wherein said yoke includes a generally cylindrical inner cavity rotatably receiving said connector means, the saddle-shaped surface of said retaining means having a curvature which substantially corresponds to the curvature of said yoke inner cavity.

6. The rotary coupling system of claim 4 wherein the other face of the retaining means is provided with an axial opening receiving said biasing means, said retaining means further including a pair of diametrically opposed slots extending axially thereof from said other face in communication with said axial opening for receiving said locking means.

7. The rotary coupling system of claim 6 wherein said biasing means is operatively interposed between said retaining means and said locking means, said locking means being releasably secured to said yoke at said yoke opening, said slots being axially dimensioned so that they do not stoppingly engage said locking means when said retaining means is moved to its outward limit of axial movement as defined by said second limit means.

8. A self-adjusting pivot pin retaining block mountable in the pivot pin entry opening of a yoke through which a pivot pin is adapted to be inserted into aligned openings in a rail car coupler and in a connector, said retaining block comprising:

a body portion having a pair of opposed face areas with a generally saddle-shaped surface being provided at one of said face areas;

a plurality of flanges extending radially outward from said body portion at spaced intervals around the outer periphery thereof, said flanges being adapted to cooperate with radially inward extending support surfaces in said pin entry opening;

first inner and second outer support surfaces extending circumferentially around said pin entry opening in axial spaced relation to each other and receiving said flanges therebetween, the lateral distance between said surfaces comprising a predetermined amount greater than the thickness of said flanges for allowing said body portion to undergo a predetermined amount of axial movement in said pin entry opening;

a locking device adapted to selectively lock said body portion in a closing relationship with said pin entry opening; and, a compression spring operatively communicating with said body portion for placing a continuous biasing force thereagainst to urge said body portion axially inward of said pin entry opening until said flanges engage said first support surface.

9. The retaining block of claim 8 wherein said body portion is generally cylindrical, said spring being positioned in a recessed area provided in a second face of said body portion and cooperatively engaging said locking device.

10. A rotary coupling system for rail cars and the like, comprising:

a coupler;

a connector having a central aperture into which a portion of said coupler extends;

a pivot pin which connects said coupler and said connector;

a yoke in which said connector is rotatably mounted, said yoke having a pivot pin entry opening through which said pivot pin is introduced, said pin entry opening including a first inner support surface extending radially thereinto generally circumferentially thereof and a second outer support surface spaced axially outward along said entry opening a predetermined distance from said first support surface, said second support surface being defined by a plurality of radially inward extending support areas;

a pin retainer block for selectively closing said pin entry opening and having a plurality of spaced apart radially outward extending flange areas, said flange areas being equal in number to said support areas and cooperating therewith to selectively support said retainer block, said flange areas having a predetermined thickness less than the distance between said first and second support surfaces for allowing a predetermined amount of axial movement of said retainer block between flange area contacting positions with said first and second support surfaces;

fastener means for securing said pin retainer block in said yoke pivot pin entry opening; and, spring-biasing means cooperating with said pin retainer block for continuously placing a biasing force thereagainst to urge said pivot pin away from said pivot pin entry opening toward contact with the wall of said yoke disposed opposite thereto.

11. The rotary coupling system of claim 10 wherein said pin retainer block is generally cylindrical, said fastener means comprising an elongated member extending through aligned apertures in said pin retainer block and yoke for retaining said block in said yoke.

12. A rotary coupling system for rail cars and the like, comprising:

a coupler having a shank portion including an aperture extending transversely therethrough;

connector means having an end opening for receiving the shank and including a pair of spaced apart coaxial apertures alignable with said shank aperture, said connector means being rotatable about an axis of rotation normal to the axis of said aligned apertures;

fastening means insertable into said aligned connector means apertures and said shank aperture for selectively interconnecting said coupler and connector means;

a yoke for rotatably retaining said connector means, said yoke having an opening which is alignable with said connector means apertures and said coupler shank aperture and adapted to receive the fastening means therethrough;

retaining means for retaining said fastening means in a connecting position with said connector means apertures and said shank aperture, said retaining means being selectively insertable into said yoke opening for closing said opening and further including a locking means for selectively locking said retaining means in a closing position in said yoke opening;

said yoke opening including first inner and second outer support surfaces extending circumferentially thereof, said first and second support surfaces defining first and second limit means, respectively, said first limit means defining an inward limit of movement of said retaining means in said yoke opening and said second limit means defining an outward limit of movement of said retaining means in said yoke opening, said first and second limit means being spaced apart from each other axially of said yoke opening by a predetermined distance for accomodating maximum tolerance variations in the system components while allowing said retaining means to urge said fastening means toward engagement with the wall of said yoke opposite from said yoke opening;

said retaining means including radially outward extending support areas having a predetermined thickness receivable between said first and second support surfaces, and the distance between said support surfaces being a predetermined amount greater than said thickness of said support areas for allowing said retaining means to undergo a predetermined amount of axial movement;

compressible biasing means operatively communicating with said retaining means for placing a continuous biasing force thereagainst for urging said retaining means axially inward of said yoke opening toward the yoke interior;

said retaining means including a generally disc-shaped retainer block and a retainer block insert disposed in cooperable association with each other, said biasing means being operably interposed between said retainer block and retainer block insert; and said second support surface being defined by a plurality of support surface segments spaced apart from each other around said yoke opening, said retainer block having a plurality of radially outward extending flanges and said retainer block insert having a plurality of radially outward extending fingers, said flanges and fingers being cooperable to secure said retainer block and retainer block insert against relative rotation.

13. The rotary coupling system of claim 12 wherein the fingers of said retainer block cooperate with said support surface segments for maintaining said retaining means in said yoke opening, said biasing means urging said retainer block flanges toward contact with said first support surface and said retainer block insert fingers into a cooperable relationship with said support segments.

14. The rotary coupling system of claim 11 wherein said retainer block and said retainer block insert define said locking means.

15. A self-adjusting pivot pin retaining block mountable in the pivot pin entry opening of a yoke through which a pivot pin is adapted to be inserted into aligned openings in a rail car coupler and in a connector, said retaining block comprising:

a generally disc-shaped body portion having a pair of opposed face areas with a generally saddle-shaped surface being provided at one of said face areas;

a plurality of flanges extending radially outward from said body portion at spaced intervals around the outer periphery thereof, said flanges being adapted to cooperate with radially inward extending support surfaces in said pin entry opening;

an insert portion having a plurality of spaced radial fingers extending outwardly thereof, said body flanges and fingers cooperating to prevent relative rotation between said body portion and insert portion;

first inner and second outer support surfaces extending circumferentially around said pin entry opening in axial spaced relation to each other and receiving said flanges therebetween, the lateral distance between said surfaces comprising a predetermined amount greater than the thickness of said flanges for allowing said body portion to undergo a predetermined amount of axial movement in said pin entry opening;

a locking device adapted to selectively lock said body portion in a closing relationship with said pin entry opening; and, a compression spring operatively communicating with said body portion for placing a continuous biasing force thereagainst to urge said body portion axially inward of said pin entry opening until said flanges engage said first support surface.

16. The retaining block of claim 15 wherein said compression spring is interposed between said body and insert portions, said body and insert portions cooperating to define said locking device when positioned intermediate said support surfaces and urged apart by said spring so that said fingers lockingly cooperate with said second support surface.

17. A rotary coupling system for rail cars and the like, comprising:

a coupler;

a connector having a central aperture into which a portion of said coupler extends;

a pivot pin which connects said coupler and said connector;

a yoke in which said connector is rotatably mounted, said yoke having a pivot pin entry opening through which said pivot pin is introduced, said pin entry opening including a first inner support surface extending radially thereinto generally circumferentially thereof and a second outer support surface spaced axially outward along said entry opening a predetermined distance from said first support surface, said second support surface being defined by a plurality of radially inward extending support areas;

a pin retainer block for selectively closing said pin entry opening including a generally disc-shaped upper block member having a plurality of spaced apart radially outward extending flanges, said flanges being equal in number to said support areas and cooperable therewith to selectively support said retainer block, said flanges having a predetermined thickness less than the distance between said first and second support surfaces for allowing a predetermined amount of axial movement of said retainer block between flange contacting positions with said first and second support surfaces, said pin retainer block further including a block insert having a plurality of radial fingers extending outwardly thereof in cooperation with said flanges for preventing relative rotation between said upper member and said block insert;

fastener means for securing said pin retainer block in said yoke pivot pin entry opening; and, spring-biasing means cooperating with said pin retainer block for continuously placing a biasing force thereagainst to urge said pivot pin away from said pivot pin entry opening toward contact with the wall of said yoke disposed opposite thereto.

18. The rotary coupling system of claim 17 wherein said spring-biasing means comprises a compression spring interposed between said retainer block upper member and retainer block insert, said retainer block upper member and retainer block insert cooperating to define said fastener means when positioned between said support surfaces and urged apart from each other by said spring.

* * * * *